US005725060A

United States Patent [19]

Blount et al.

[11] Patent Number: 5,725,060

[45] Date of Patent: Mar. 10, 1998

[54] MILL STARTING DEVICE AND METHOD

[75] Inventors: Curtis G. Blount; Lamar L. Gantt; David D. Hearn; Gregory S. Walz, all of Anchorage, Ak.

[73] Assignee: Atlantic Richfield Company, Los Angeles, Calif.

[21] Appl. No.: 409,246

[22] Filed: Mar. 24, 1995

[51] Int. Cl.[6] ..... E21B 7/04

[52] U.S. Cl. ..... 175/61; 166/50; 166/117.5; 166/384

[58] Field of Search ..... 175/61; 166/50, 166/117.6, 384, 117.5

[56] References Cited

U.S. PATENT DOCUMENTS

| | | | |
|---|---|---|---|
| 5,188,190 | 2/1993 | Skaalure | 175/81 X |
| 5,211,715 | 5/1993 | Braden et al. | 166/117.5 X |
| 5,277,251 | 1/1994 | Blount et al. | 166/117.5 |
| 5,287,921 | 2/1994 | Blount et al. | 166/117.6 |
| 5,427,179 | 6/1995 | Bailey et al. | 175/81 X |

*Primary Examiner*—Roger J. Schoeppel
*Attorney, Agent, or Firm*—Michael E. Martin

[57] ABSTRACT

A mill starting device for use in a pipestring in a wellbore which provides an inclined wall for guiding the mill to a shoulder stop so that when the mill is operated it preferentially bites into the shoulder stop and a method for using the device together with coiled tubing for forming a window in a subsurface well conduit.

20 Claims, 5 Drawing Sheets

MILL STARTING DEVICE AND METHOD

BACKGROUND OF THE INVENTION

In subterranean well operations, it is necessary from time to time to remove a section of subsurface well conduit (pipestring) such as a tubing string or a casing string to form a window therein. Accordingly, several types of tubing and/or casing pipestring cutting and milling tools and procedures have been developed for use with conventional rotary drilling rigs. The cost and time consumed in using a conventional rotary drilling rig is considerable and there has been a trend towards the use of coiled tubing units for various well operations heretofore conducted with conventional drilling rigs.

Coiled tubing units are known in the art, but not widely used in the field yet. Coiled tubing units are, nevertheless, available on a commercial basis and are known to those skilled in the art. Inventions such as that disclosed herein help render coiled tubing units more readily useful in the field by not only reducing the cost and time expenditure, as compared to a conventional drilling rig, but also the reliability of operation of the coiled tubing equipment used downhole.

Heretofore, tools and procedures have been developed for use with conventional drilling rigs for removing a section of a well conduit or pipestring, whether it is tubing or casing, but these tools and procedures cannot readily be transferred unchanged to a coiled tubing unit and employed successfully in the same manner as employed in the conventional drilling rig. The use of conventional drilling rig tools and procedures in a coiled tubing context has several shortcomings. For example, control over the axial downward pressure on the tool or tools employed downhole is difficult to maintain because of the flexibility of the coiled tubing string itself. Accordingly, the cutting or milling tool may wear prematurely or unduly cut into other downhole tools such as whipstocks. The tools may also deflect the pipestring being cut resulting in failure of the tools themselves and/or jamming of the tools in the pipestring thereby causing an expensive fishing job or even abandonment of the well.

Further, conventional drilling rig cutting and milling tools are not adapted to be inserted into a casing pipestring through a smaller diameter tubing pipestring contained in that casing string. These types of tools require removal of the tubing string in its entirety from the casing and wellbore before the cutting and milling tools can be inserted into the casing and operated to form a window or aperture in that casing.

Conventional rotary drilling rigs often put a very large amount of weight on the pipestring cutting and milling tools in order to make up for the relatively slow rotation speed of a rotary rig, but this weight can have a disadvantage of sometimes rotating and therefore disorienting the whipstock with the result that the window is not formed at the desired location in the pipestring. With a coiled tubing unit, the cutting and milling tools can be routinely rotated at much higher speed than with a conventional rotary rig, thereby eliminating the need for putting large amounts of weight on those tools in operation as is normally done with a conventional rotary rig.

SUMMARY OF THE INVENTION

Accordingly, this invention provides a device and method for forming an aperture or window in a subsurface well pipestring or conduit using a coiled tubing unit and a downhole motor/mill combination. In this invention the mill is stopped at a predetermined location in the pipestring at the exact point where the window is to be milled. The mill, when operated, is then guided so that it will preferentially bite into the pipestring itself and thereby be directed toward the pipestring and away from any other equipment, such as a whipstock, that is located in the interior of the pipestring adjacent the point where the window is to be cut.

By this invention a mill starting device is employed in the pipestring in the wellbore, the device carrying, on an internal surface thereof, a guidewall and shoulder stop designed to catch and stop the mill and, upon operation of the mill, guide the mill preferentially toward the pipestring and away from equipment carried internally of the pipestring adjacent the milling location.

In accordance with this invention there is also provided a method for forming a window in a subsurface wellbore pipestring using coiled tubing equipment including a downhole motor/mill combination wherein the mill is stopped and rigidly held at a predetermined point where milling of the pipestring is to commence. The mill is then preferentially guided against the pipestring and away from other equipment located in the pipestring at the milling location so that essentially all the energy of milling is directed into the pipestring. This provides a very predictable and reliable process for making certain that milling starts at the exact point where it is desired to start and all the energy is directed toward the pipestring to be milled. This provides a faster and more reliable process for starting and creating a window in a subsurface wellbore pipestring.

This invention is adapted to use a conventional "window" mill which, as will be shown hereinafter, is quite different in structure from the standard starting mill. This invention uses the window mill as the initial and primary mill for forming the window whereas the prior art uses a starting mill as the initial and primary mill for forming a window. The mill starting device of this invention allows for the unconventional use of a window mill at the very beginning of the milling operation and assures essentially no milling on the guide surface of an adjacent whipstock, cement, or other materials. Thus, as will be shown hereinafter, not only is the conventional starting mill eliminated by this invention, but also the standard wear projection on a whipstock is also eliminated.

The elimination of starting mills and whipstock wear projections, without more, runs a substantial risk of the window mill cutting into the whipstock while it is milling a window in the pipestring. In such a situation, the mill could even preferentially cut into the whipstock if the initial bite of the mill is more into the whipstock than into the pipestring. Such a situation severely damages the whipstock and can substantially increase the time and cost of the window formation operation. It can even result in a poorly cut window which can catch or hang other tools which are subsequently run through the window while carrying out subsequent well operations.

Inventions have been made to avoid this result such as that disclosed in U.S. Pat. No. 5,277,251, issued to Blount, et al, the disclosure of which is incorporated herein by reference. The invention in U.S. Pat. No. 5,277,251 obtains its desired results by carefully controlling the angular relationship of the downhole motor/mill combination in relation to the guide surface of the whipstock and this invention works very well. However, sometimes, due to downhole conditions that are beyond the control of the operator, it is difficult to obtain the correct angular relationship and, therefore, it is desirable in some situations to have a more rigidly acting device and method which, although employing less finesse, very reliably causes at the outset preferential biting of the mill into the pipestring in which the window is to be cut, thereby just as reliably and predictably sparing any milling of the whipstock whatsoever.

Accordingly, this invention gets the results desired when finesse will not for reasons beyond the control of the operator.

Accordingly, it is an object of this invention to provide a new and improved device and method for forming a window in subsurface pipestrings.

It is another object to provide a new and improved method for employing coiled tubing technology, together with conventional downhole tools in a manner such that all the advantages of the coiled tubing unit can be achieved but without the disadvantages normally encountered when conventional tools are employed without modification on coiled tubing.

It is another object to provide a new device for very reliably initiating and then forming a window at a known location in a pipestring and a method for using such a device which will put essentially all of the milling energy into the pipestring and not into any other equipment that is located in the pipestring adjacent the milling activity.

Other aspects, objects and advantages of this invention will be apparent to those skilled in the art from this disclosure and the appended claims.

DETAILED DESCRIPTION OF A PREFERRED EMBODIMENT

Figure 1:
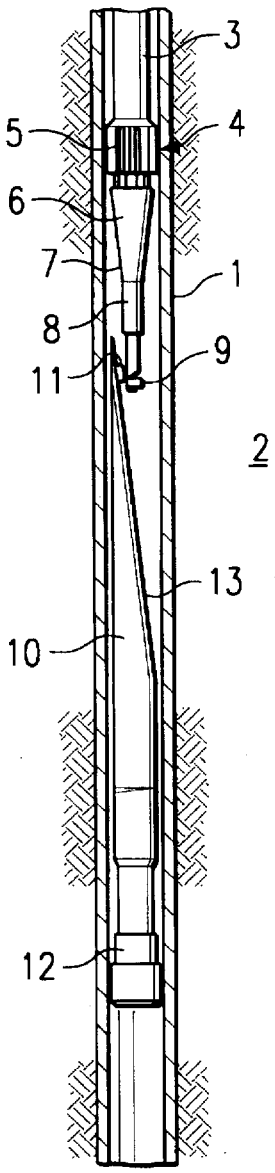
FIG. 1 (PRIOR ART)
FIGS. 1, 2 and 3 show a conventional rotary rig prior art process for forming a window in a subsurface well conduit.

Referring to FIG. 1, there is shown a conventional subsurface pipestring or well conduit 1 which, in the case of FIG. 1, is casing. Casing 1 lines a wellbore that has been drilled into earth 2 a finite distance. At the earth's surface (not shown) a conventional rotary drilling rig (not shown) employs a conventional jointed pipe (non-coiled) string 3 which is composed of a plurality of straight sections of pipe joined to one another by conventional coupling means at the bottom of which is carried a conventional starting mill 4. Starting mill 4 is composed of a cutting head 5 that is designed to cut through casing 1. Below head 5 extends a frusto-conical member 6 having a sloping wear or guide surface 7. Member 6 carries, at its lower end, a sub 8 which is adapted at its lower end to carry shear pin 9. Shear pin 9 is connected to conventional whipstock 10 through wear projection 11. Wear projection 11 is often referred to in the art as a wear pad or wear lug and remains as a fixed projection on surface 13 after pin 9 is sheared and sub 8 separated from whipstock 10. Whipstock 10 is connected to and rests upon a conventional pack-off 12.

Whipstocks normally have a guide surface 13 which cuts across the long axis of the wellbore and well conduits therein such as casing 1. Gear surface 7 bears on wear projection 11 to direct mill head 5 against casing 1 after shear pin 9 is sheared. Thus, in operation, the assembly of tools from reference numeral 5 through reference numeral 10 are set down on packer 12 in one trip into the wellbore and thereafter whipstock 10 is suitably engaged with packer 12. Shear pin 9 is sheared by additional downward workstring weight thereon transmitted through jointed pipe 3 from the drilling rig at the surface of the earth. Since wear projection 11 is formed on guide surface 13 so that it remains after shear pin 9 is sheared, further movement downward of starting mill 4 caused by the lowering of pipe 3 and engagement of sloped surface 7 with wear projection 11 forces mill head 4 away from guide surface 13 against casing 1 to form the desired window 15 (FIG. 2) in casing 1.

Figure 2:
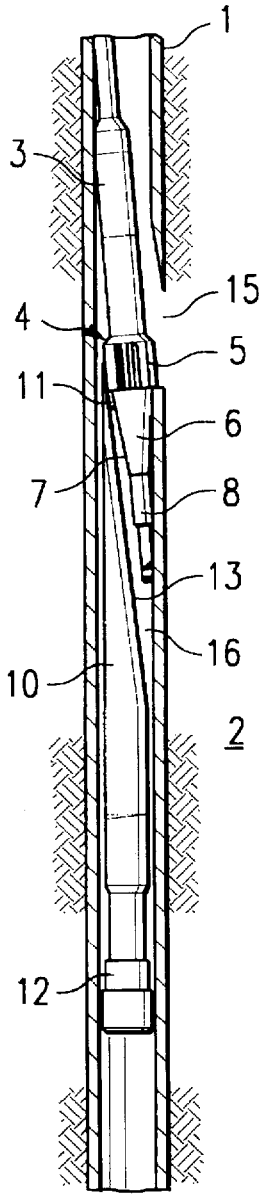
FIG. 2 (PRIOR ART)

The result of such operation is shown in FIG. 2 which shows mill head 5 to have cut window 15 in casing 1. Note in FIG. 2 that the length of window 15 formed along the longitudinal length of casing 1 is limited substantially by members 6 and 8 which eventually jam between guide surface 13 and casing 1 when members 6 and 8 approach the lower end of interior space 16 that exists between the inner wall of casing 1 and guide surface 13. Such a disadvantage is avoided by the method of this invention.

Figure 3:
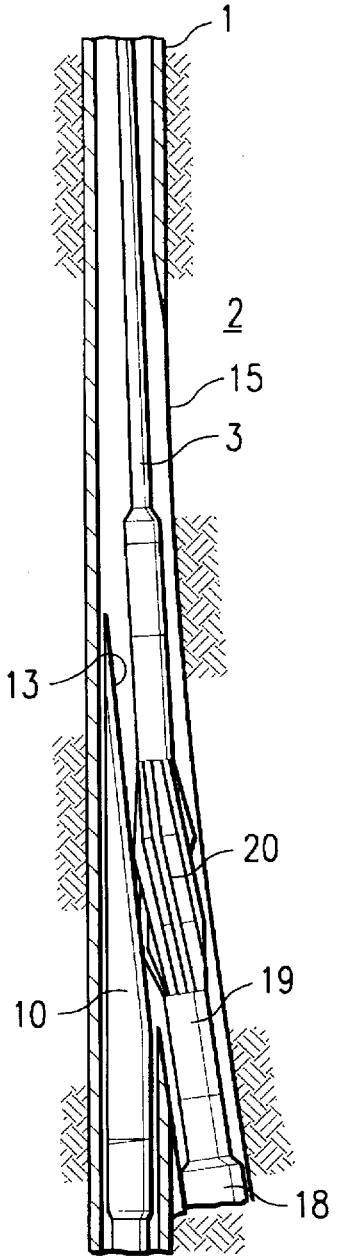
FIG. 3 (PRIOR ART)

FIG. 3 shows the next prior art step, after initial window formation with starting mill 4 of FIGS. 1 and 2, to involve enlarging window 15 by use of a window mill 18 which can be a diamond speed mill, crushed carbide mill or the like and which is conventionally employed after a starting mill has formed an opening in the pipestring wall. The desired window is formed by the window mill. Window mill 18 does not employ guide member 6 or rely on wear projection 11. Window mill 18, which is connected by way of sub 19 to a watermelon shaped mill 20, all of which are carried at the bottom of pipestring 3 and operated from the earth's surface by way of the rotary table (not shown) on a conventional drilling rig at the earth's surface.

The method described for FIGS. 1 through 3 requires a plurality of trips into and out of the wellbore such as setting whipstock 10 onto packer 12, and enlarging and dressing the window by use of window mill 18 and watermelon mill 20. The large amounts of weight put on mills 4, or 18 and 20 by the rotary rig, substantially increases the risk of disorienting (rotating) whipstock 10 and forming window 15 in a position other than that desired. If window 15 is not formed in the desired location, the procedure has to be repeated, if possible, or else the proposed well lost. By use of the device and method of this invention, as hereafter described in detail, the time required for the foregoing window formation can be cut at least in half and a significant cost reduction achieved in addition to the time savings realized. Further, the number of trips into and out of the wellbore when forming a window can be sufficiently reduced to achieve even more time and cost savings. Further, by the practice of this invention it is virtually assured that the window will be started at exactly the point desired along the pipestring and that essentially all of the energies put into the milling operation will be directed to the pipestring and away from the whipstock.

Yet additional savings can be realized by this invention when employed through tubing already existing inside casing in a wellbore. This is so because this invention can be practiced through the tubing without the necessity of removing that tubing from the wellbore before a window is formed in the casing below the point where the tubing ends. It should be understood, however, that this invention is not limited to through-tubing applications, but can be employed to form a window in production tubing itself or in wells where tubing is not present inside the casing.

Thus, the practice of this invention obtains the longest window available with substantially less milling time than required by prior art FIGS. 1 through 3, and this result is achieved, if desired, by eliminating one or more of the trips in or out of the wellbore as required by the procedure just described hereinafter for FIGS. 1 through 3.

Figure 4:
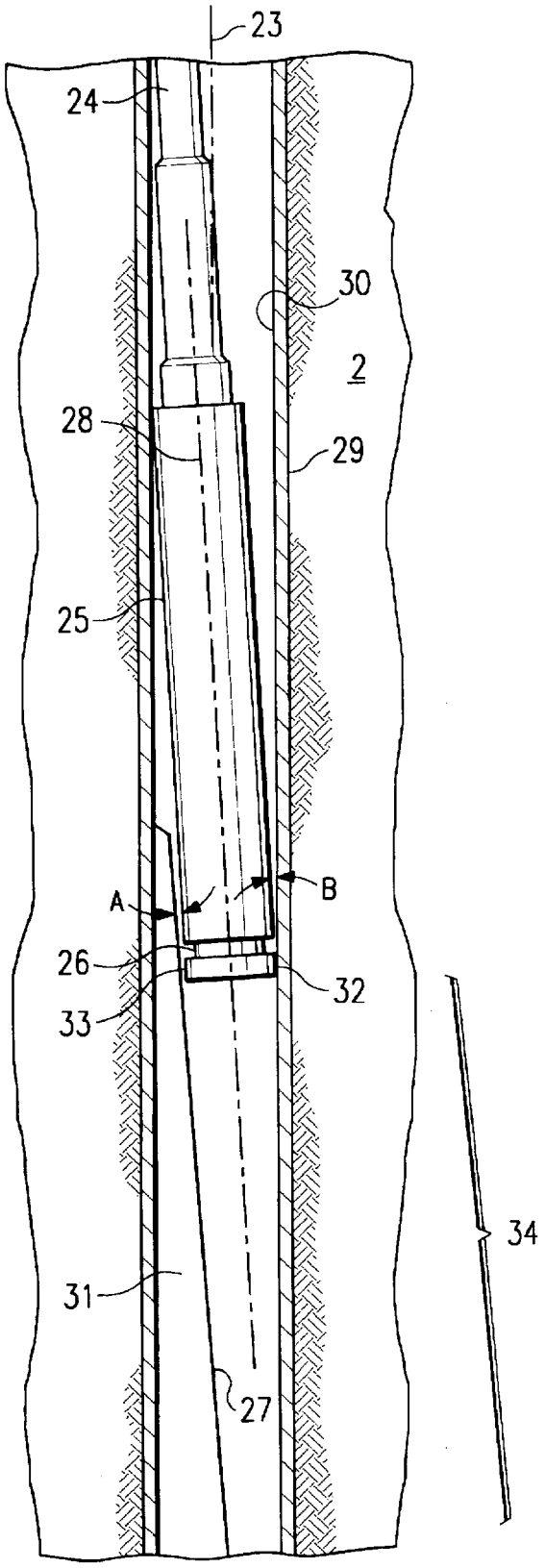
FIG. 4 (PRIOR ART)
FIG. 4 shows a prior art approach for maintaining angular relationships between the mill, whipstock, and pipestring.

FIG. 4 shows other prior art which employs a downhole motor/mill combination 25-26 on coiled tubing 24 inside pipestring (casing) 29. It can be seen that when motor/mill combination 25-26 engages guide surface 27 of whipstock 31, longitudinal axis 28 of the tool combination is at an angle with relation to the longitudinal axis 23 of casing 29. The motor/mill combination 25-26 is desirably at an angle such that mill 26 will engage inner wall 30 of casing 29. Mill 26 cannot engage wall 30 at just any angle. If the angle of the longitudinal axis 28 is not correct, mill 26 can bite into whipstock 31 to a considerable extent, if not preferentially, thereby considerably slowing the rate at which the desired window is formed and losing some of the cost and time advantage incurred by employing a coiled tubing unit in the first place. Thus, it is important in the practice of the method represented by FIG. 4, that the relationships between angles A and B be carefully controlled. If, for reasons beyond the control of the operator, angles A and B cannot be correctly controlled, the risk of mill 26 biting into whipstock 31 instead of pipestring 29 is increased. The device and method of this invention minimize this risk. However, when the relationship between angles A and B that is desired is achieved, window 15 of FIG. 3 will be formed in the area 34 of FIG. 4 in a swift, reliable and cost-effective manner.

Figure 5:
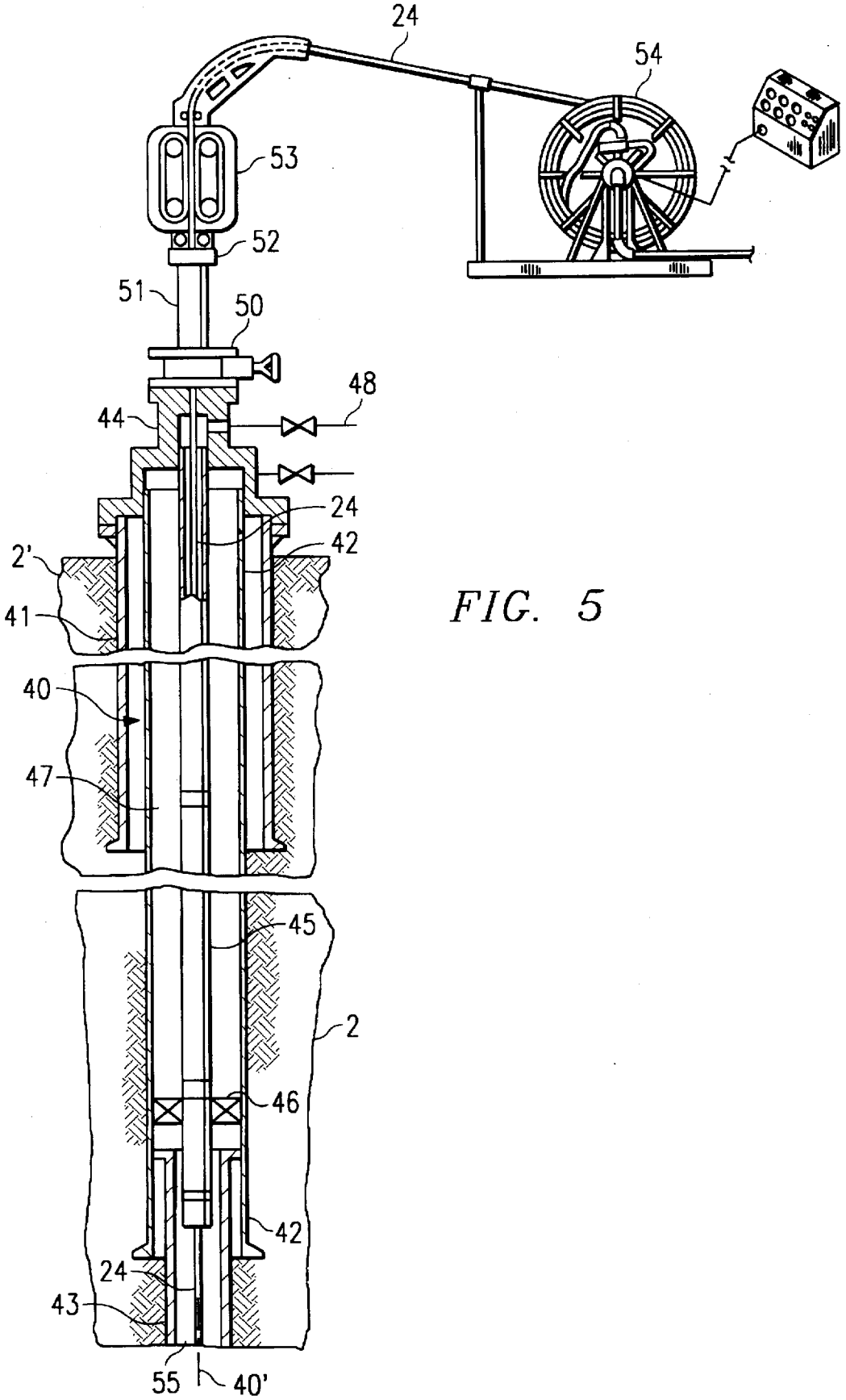
FIG. 5 shows one embodiment of conventional coiled tubing apparatus that can be employed in the practice of this invention.

FIG. 5 shows conventional coiled tubing apparatus that can be employed with the device and the method of this invention. FIG. 4 shows a cross-section of an oil and gas production well generally designated 40, whose longitudinal axis 23 extends downwardly into earth 2 from the surface 2' thereof. Well 40 includes a conventional surface casing pipestring 41, an intermediate casing pipestring 42, and a production liner or casing pipestring 43 extending into a subsurface oil and gas producing zone (not shown). A conventional wellhead 44 is connected to casing strings 41 and 42 and is also suitably connected to production tubing string 45 extending within casing 42 and partially within casing 43. A seal is formed in the wellbore between tubing 45 and casing 42 by packer 46 or the like, thereby defining an annulus 47. Fluids from the producing zone flow through production tubing 45 to production flowline 48 for storage, treatment, transporting, or the like. The well structure described to this point is conventional and known to those skilled in the art.

Wellhead 44 is not superimposed at earth surface 2' by a conventional rotary drilling rig. Instead, wellhead 44 is provided with a conventional crown valve 50 and a lubricator 51 mounted on crown valve 50. Lubricator 51 includes a stuffing box 52 through which may be inserted or withdrawn, coiled tubing string 24 which is shown extending through tubing string 45 into closing 43 and which will thereafter be diverted through a window (not shown) but just like window 15 of FIG. 3. Tubing string 24 is adapted to be inserted into and withdrawn from the interior space of tubing 45 by way of tubing injection unit 53 which is known in the art. Tubing string 24 is normally coiled onto a storage reel 54 which is also known in the art.

Figure 6:
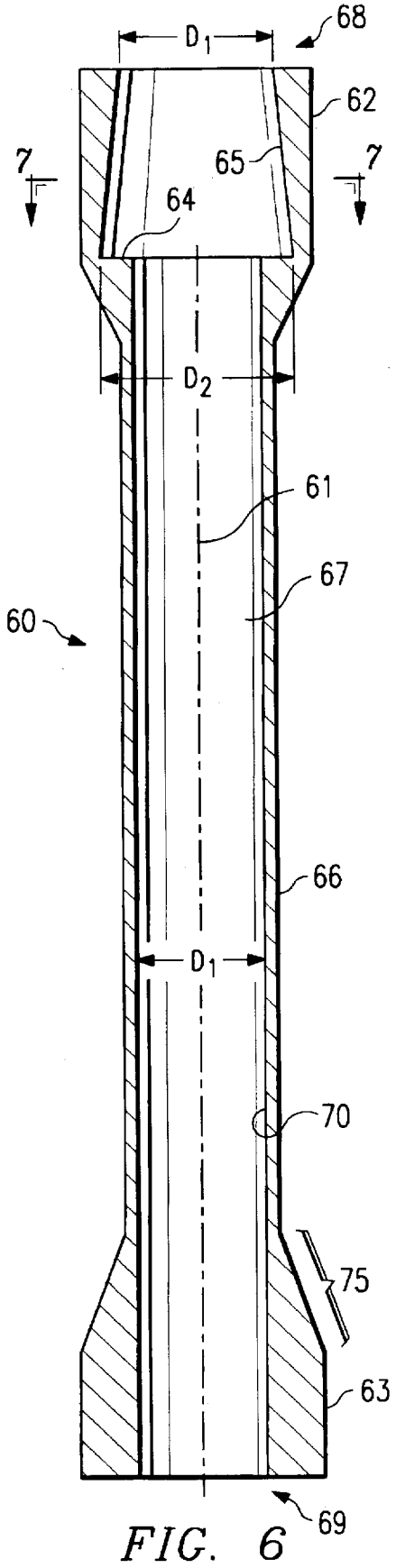
FIG. 6 shows one embodiment of the mill starting device of this invention.

FIG. 6 shows one embodiment of the mill starting device of this invention which can be employed in casing 1 of FIG. 1 adjacent whipstock 10 or in casing 43 of FIG. 5 also adjacent a whipstock (not shown, but like whipstock 10 of FIG. 1) disposed in interior 55 of casing 43 at the location where the desired window is to be cut.

FIG. 6 shows a mill starting device for use in a pipestring (tubing, casing or other well conduit) in a wellbore, the device comprising an elongate tubular member 60 having a long axis 61. Opposing ends 62 and 63 of member 60 can be threaded or otherwise conformed so that member 60 can be inserted into a downhole pipestring as just another section of pipe. Thus, for example, in the case of FIG. 5 and casing 43 of that Figure, upper end 62 of member 60 would be threadably engaged by a conventional coupling or other means to upper sections of casing 43 while lower end 63 of member 60 would be similarly threadably engaged to lower sections of casing 43. Member 60 is inserted in casing 43 in the vicinity where a whipstock is to be set and a window milled, as shown in FIGS. 1 and 2, member 60 just being another section of pipe in the pipestring that composes casing 43. However, the difference between member 60 and all the other sections of pipe that compose casing 43 is the combination of shoulder 64 and inclined guidewall 65 carried interiorly of member 60. The shoulder-inclined guidewall combination can be employed anywhere along the interior length of member 60 and more than one shoulder and guidewall combination can be employed if desired.

Member 60 has an outer surface 66 and an elongate internal cavity 67 which extends along long axis 61 throughout the length of member 60, i.e. to and including first upper opening 68 and second lower opening 69. Cavity 67 thereby defines inner surface 70 of member 60. Cavity 67 has a first diameter $D_1$ which terminates at inner surface 70 and is uniform throughout the length of member 60. First diameter $D_1$ is preferably essentially the same as the interior diameter of the casing 43 in which member 60 is mounted. Cavity 67 also preferably has a cross-section coextensive with the cross-section of the interior space of the casing or other pipestring in which it is mounted so that cavity 67 and the interior space of the pipestring in which it is mounted are in full and open communication with one another.

Figure 7:
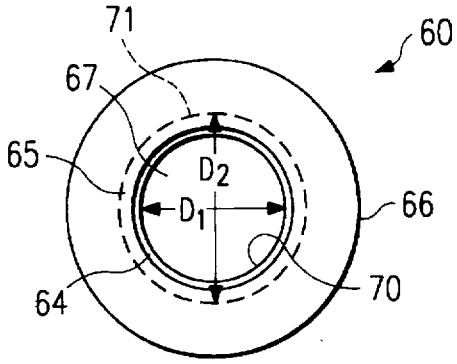
FIG. 7 shows a cross-section of the device of FIG. 6.
Figure 8:
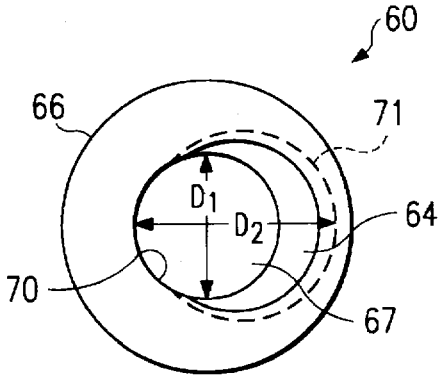
FIG. 8 shows a cross-section of a device similar to FIG. 6 but modified as to its shoulder feature.

At inner surface 70 where first diameter $D_1$ terminates, shoulder 64 starts and extends at an angle to long axis 61 a finite distance outwardly from inner surface 70 towards outer surface 66 but before reaching outer surface 66 terminates in an outer edge 71. Thus, the inner diameter of shoulder 64 is first diameter $D_1$ while the outer diameter of shoulder 64 is second diameter $D_2$. Shoulder 64 can extend around the entire periphery of inner surface 70, as shown in FIGS. 6 and 7 or around just a portion of that inner periphery, as shown in FIG. 8.

Inclined guidewall 65 is located in the vicinity of shoulder 64 and, when member 60 is mounted in a pipestring, above or upstream of shoulder 64, upstream being on the side closer to the earth's surface. Guidewall 65 starts at inner surface 70 a predetermined distance above shoulder 64 and extends outwardly toward outer surface 66 as it approaches shoulder 64 until it terminates at outer edge 71 of shoulder 64, thereby providing for mill 26 of FIG. 4 a combination stop member by way of shoulder 64 and guide member by way of inclined wall 65. The notch resulting from the coaction of inclined wall 65 and shoulder 64 provides a rigid stop by way of shoulder 64 for mill 26. The rigid stop is provided at the exact point where the window milling is to begin so that shoulder 64 provides a precisely known location where the window will be started. The coaction of inclined wall 65 with shoulder 64 provides a recess such that mill 26 will bear with its weight and the weight of the motor and coiled tubing string above it fully and completely on member 60, which is part of the pipestring. This will cause mill 26, upon operation of downhole motor 25, to bite preferentially into the pipestring by way of member 60 and just as preferentially be directed away from any other equipment such as a whipstock that is located in cavity 67 adjacent and below shoulder 64.

Although the cross section of cavity 67 can be of any desired configuration, it is normally the same as the cross-section of the pipestring in which it is carried. The normal cross-section for both cavity 67 and the interior of conventional pipestrings is essentially round. First diameter $D_1$ is essentially the same throughout cavity 67 including first and second openings 68, 69. Shoulder 64 can extend essentially transverse to long axis 61 or at any desired acute angle thereto, as will be shown in greater detail hereinafter, so long as a fixed stop and inclined guidewall is provided for the mill when initiating a cut into the pipestring to be milled.

By employing shoulder 64 around the entire inner periphery of member 60, as shown in FIG. 6, the directional orientation of member 60 becomes unimportant because whatever position a whipstock is subsequently placed in inner cavity 67, there is always a portion of shoulder 64 and guidewall 65 opposing the guide surface of that whipstock. This is shown better in FIG. 7 wherein the cross-section of cavity 67 is essentially round and shoulder 64 extends completely around the inner periphery of member 60. In contrast, FIG. 8 shows an embodiment within this invention wherein shoulder 64 extends around only the right half of the inner periphery of member 60 leaving the left half of inner surface 70 untouched. The left half being, with this embodiment, the location in which the whipstock would be set so that the guide surface of the whipstock would be facing the right half where shoulder 64 is located. If external collars are employed as a means for connecting member 60 in a pipestring such as that shown at lower end 63 of member 60 in FIG. 6, it is preferable that the collars be tapered, as shown at 75, to assure that the mill does not continue along member 60 once it exits the window.

Figure 9:
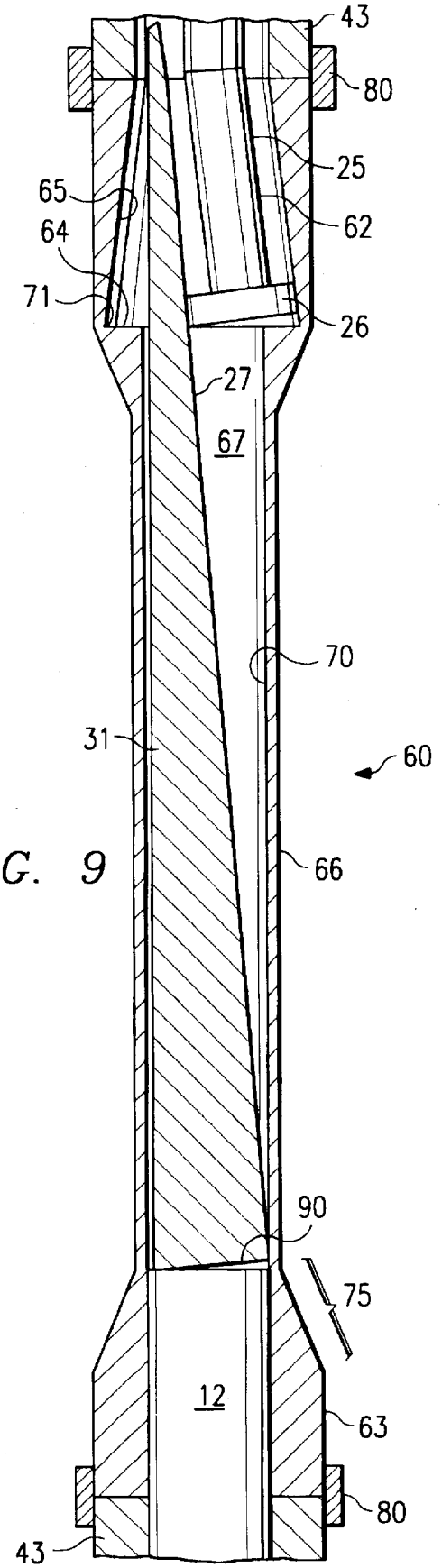
FIG. 9 shows the device of FIG. 6 in operation with a whipstock and downhole mill just before milling is begun.

FIG. 9 shows the device or sub of this invention employed in casing string 43 of FIG. 5 wherein member 60 is carried between two upper and lower sections of casing 43 by means of conventional internally threaded couplings 80 so that member 60 is just another section of pipe in the overall length of casing 43. FIG. 9 shows conventional whipstock 31 without a wear projection 11 (FIG. 1) disposed upon pack-off 12 in cavity 67 of sub 60. When set in the manner shown in FIG. 9, whipstock 31 and its guide surface 27 in cooperation with inclined guidewall 65 directs mill 26 hard against shoulder 64 so that the main weight of the mill 26, motor 25 and coiled tubing 24 extending thereabove, is imposed on shoulder 64 and little or no weight imposed on guide surface 27 of whipstock 31. This way, shoulder 64 stops mill 26 exactly at the point where cutting is to be initiated. Once cutting is initiated by operation of motor 25, mill 26 clearly first bites into the material of member 60 and not the material of whipstock 31. It is well known that a cutting member will preferentially move toward that material which it is cutting. Therefore, upon operation of mill 26, it will first cut, and strongly bite into, the material below shoulder 64 thereby preferentially pulling mill 26 to the right towards outer surface 66 and away from guide surface 27. Accordingly, it is clear that little, if any, wear is imposed by mill 26 on guide surface 27 so that essentially all of the cutting energy of motor 25 and mill 26 is directed to sub 60 for maximum and most efficient window cutting by mill 26. In this way one of the most difficult steps in side-tracking a well, i.e. initiating the cut into the casing to be milled for a window, is very reliably located, initiated, and continued to completion with no energy wasted on milling a portion of whipstock 31 while the window is being cut.

Figure 10:
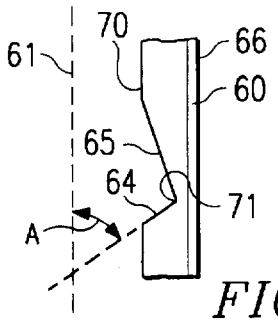
FIGS. 10 through 14 show various embodiments of the shoulder and guidewall feature of this invention.

FIG. 10 shows an embodiment within this invention wherein shoulder 64 extends at acute angle A with relation to long axis 61. It can be seen that shoulder 64 need not be essentially transverse to long axis 61, as shown in FIG. 6.

Figure 11:
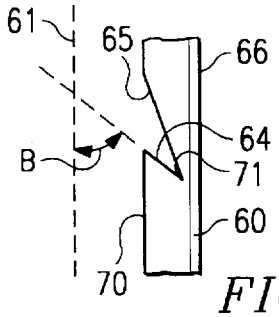

FIG. 11 shows another embodiment wherein shoulder 64 extends away from inner surface 70 at acute angle B with respect to long axis 61 thereby showing that shoulder 64 can angle downwardly, as well as upwardly, and still achieve the benefits of this invention.

Figure 12:
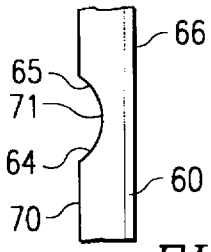

FIG. 12 shows an embodiment which demonstrates that neither shoulder 64 nor guidewall 65 need be essentially straight walls. In FIG. 12 guidewall 65 is curvelinear as is shoulder 64, outer edge 71 of shoulder 64 being that point where mill 26 is no longer guided by wall 65, but rather rests on stop portion 64.

Figure 13:
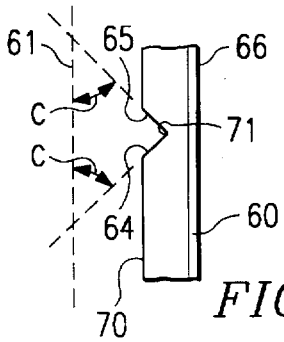

FIG. 13 shows that shoulder 64 and guidewall 65 can be roughly at the same angle of deviation from long axis 61 in that acute angles C for wall 71 and shoulder 60 are essentially the same in FIG. 13.

Figure 14:
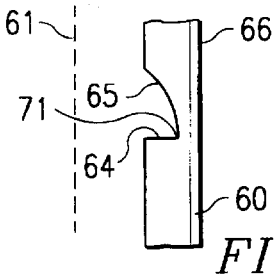

FIG. 14 shows that guidewall 65 and shoulder 64 can be a combination of straight and curvelinear, FIG. 14 showing guidewall 65 curvelinear while shoulder 64 is essentially straight. Of course, shoulder 64 could be curvelinear and guidewall 65 straight, if desired. In such combinations, shoulder 64 can be essentially transverse to long axis 61, as shown in FIG. 14, or at various angles thereto, as shown for FIGS. 10 through 13.

In the method of this invention a subsurface wellbore pipestring of any type of well conduit, be it tubing or casing or otherwise, and having an inner wall that defines the interior space of the pipestring such as inner wall 30 and inner space 31 of FIG. 4, has employed therein a mill starting device of this invention such as member 60 of FIG. 9, sub 60 being employed in the pipestring at the point where the window is desired to be cut. A coiled tubing injection unit carrying coiled tubing is provided together with a downhole motor-window mill combination at one end of the coiled tubing. A whipstock having an elongate guide surface is set in the interior space of sub 60, as shown in FIG. 9, the guide surface having no wear projection thereon for guiding the mill, although a wear projection can be present if desired. The motor/mill combination is inserted into the interior space of the pipestring down to the whipstock to engage the motor/mill combination with the guide surface of the whipstock. By employing the device of FIG. 9 along the length of the pipestring in the area where the window is desired to be formed, mill 62 is forced hard against shoulder 64, as opposed to the whipstock guide surface by means of guidewall 65, so that upon operation of the downhole motor causes the mill to cut into the shoulder preferentially to the whipstock and upon moving the motor/mill combination along the whipstock guide surface with the coiled tubing while operating the downhole motor, a portion of at least the tubular member and, depending upon the circumstances, some of the pipestring itself, is removed to form a window at the desired location in the pipestring.

In practicing the method of this invention, the motor/mill combination can be removed from the pipestring, the window mill replaced with the dressing mill, and the motor-dressing mill combination reinserted into the pipestring so that the dressing mill can be rotated through the window previously formed by the window mill to dress up the edges thereof for ease of passage of tools thereafter through the window. In the practice of this method, the window mill is preferably rotated at least about 150 rpm when milling the window, which is a considerably higher rotating speed than can be accomplished with a conventional rotary drilling rig. The foregoing process can be employed in a pipestring which has no production tubing in the interior thereof or it can be employed where there is production tubing carried in the interior of a pipestring in which case the motor/mill combination is passed through the production tubing before the window is milled in the pipestring without having to remove the production tubing from the pipestring first.

Of course, if desired, the motor/mill combination used in this invention can contain a dressing mill in addition to the window mill thereby to eliminate a trip out of the pipestring to replace the window mill with the dressing mill.

As an example, in carrying out the method just described hereinabove using sub 60 of FIG. 9, the window mill can be set firmly on shoulder 64 and only guided by guide surface 27 of whipstock 31 without mill 26 cutting thereinto. If diameter $D_1$ is 3.892 inches and diameter $D_2$ is 4.800 inches, leaving a shoulder 64 of 0.454 inches, inclined guidewall 65 is 28.651 inches in length with an inclination angle of 1.4° from long axis 61. Whipstock 31 as set in internal cavity 67 is 12.279 feet in length and its guide surface 27 is inclined at an angle of 1.4°. Base 90 of whipstock 31 is 3.800 inches in diameter. Area 75 of the external collars below the whipstock are inclined at 30° from long axis 61 to assure that mill 26 does not continue along casing 43 once the mill exits the pipestring.

Reasonable variations and modifications are possible within the scope of this disclosure without departing from the spirit and scope of this invention.

What is claimed is:

1. A mill starting device for use in a pipestring in a wellbore comprising an elongate tubular member having a long axis and adapted to be carried by said pipestring, said tubular member having an outer surface and an elongate internal cavity extending along said long axis and ending in first and second openings at either end thereof, said cavity defining an inner surface of said tubular member, said cavity having a first diameter along said long axis including both said end openings, said first diameter terminating at said inner surface, a shoulder at least at one location along the length of said tubular member, said shoulder extending at an angle to said long axis, said shoulder starting at said inner surface and extending a finite distance outwardly therefrom toward said outer surface and terminating at an outer edge, said shoulder extending around at least a portion of the periphery of said inner surface, an inclined wall in the vicinity of said shoulder, said wall starting at said inner surface and extending to said outer edge of said shoulder, whereby a notch resulting from the coaction of said inclined wall and said shoulder provides a stop for a mill that is to be used to cut a window in said pipestring, said stop providing a known location where said window will be started and a recess such that said mill, when put into operation, will preferentially bite into said tubular member and thereby be directed toward said tubular member and away from any other equipment that is located in said cavity adjacent said shoulder.

2. A device according to claim 1 wherein:

said cavity is essentially round in cross section, said first diameter is essentially the same throughout said internal cavity and said first and second openings, and said outer surface in the vicinity of said first and second openings tapered.

3. A device according to claim 1 wherein:

said shoulder is essentially transverse to said long axis.

4. A device according to claim 1 wherein:

said shoulder is at an acute angle to said long axis.

5. A device according to claim 1 wherein:

said shoulder extends around essentially the entire periphery of said inner surface.

6. A device according to claim 1 wherein:

said shoulder and said inclined wall are essentially straight.

7. A device according to claim 1 wherein:

said shoulder and said inclined wall are curvilinear.

8. A device according to claim 1 wherein:

said shoulder and said inclined wall are a combination of straight and curvilinear.

9. A wellbore pipestring carrying at least one mill starting device of claim 1.

10. In a method for forming a window in a subsurface wellbore pipestring having an inner wall that defines the interior space of said pipestring, the method comprising providing a coiled tubing injection unit carrying coiled tubing, providing a downhole motor-window mill combination at one end of said coiled tubing, setting a whipstock having an elongate guide surface in said interior space at a position along the length of said pipestring where said window is to be formed, said guide surface having no wear projection thereon for guiding a mill, inserting said motor-mill combination into said interior space of said pipestring down to said whipstock to engage said motor-mill combination with said guide surface and form said window, the improvement comprising employing in said pipestring in the area where said window is to be formed a mill starting device comprising an elongate tubular member having a long axis in alignment with said pipestring and being carried by said pipestring, said tubular member having an elongate internal cavity extending along said long axis throughout the length thereof, said cavity defining an inner surface of said tubular member, said cavity and said interior space being in open communication with one another, a shoulder at least at one location along the length of said tubular member, said shoulder extending outwardly from said inner surface at an angle to said long axis and terminating at an outer edge, said shoulder extending around at least a portion of the periphery of said inner surface, and an inclined wall in the vicinity of said shoulder, said wall starting at said inner surface above said shoulder and extending to said outer edge of said shoulder, a notch resulting from the coaction of said inclined wall and shoulder being at the location along said pipestring where said window is to be started, setting said mill in contact with said shoulder, operating said downhole motor to cause said mill to cut into said shoulder, and moving said motor-mill combination along said guide surface with said coiled tubing while operating said downhole motor to cause said mill to remove at least a portion of said tubular member to form a window in same.

11. A method according to claim 10 wherein:

said motor-mill combination is removed from said pipestring, said mill is replaced with a dressing mill, and said motor-dressing mill is inserted into said pipestring and said dressing mill rotated through said window to dress up the edges thereof for ease of passage of tools through said window.

12. A method according to claim 10 wherein:

said mill is rotated at least about 150 rpm when milling said window.

13. A method according to claim 10 wherein:

said motor-mill combination is passed through at least a portion of production tubing carried in the interior of said pipestring before said window is milled in said pipestring.

14. A method according to claim 10 wherein:

said pipestring has no production tubing in the interior thereof.

15. A method according to claim 10 wherein:

said motor-mill combination contains in addition a dressing mill to thereby eliminate a trip out of said pipestring to replace said mill with said dressing mill.

16. A method according to claim 10 wherein:

said shoulder extends around the entire periphery of said inner surface.

17. A method according to claim 10 wherein:

said shoulder and said inclined wall are essentially straight.

18. A method according to claim 10 wherein:

said shoulder and said inclined wall are curvilinear.

19. A method according to claim 10 wherein:

said shoulder and said inclined wall are a combination of straight and curvilinear.

20. A method according to claim 10 wherein:

said internal cavity has a cross section coextensive with the cross section of said interior space of said pipestring; said internal cavity also having a first diameter along said long axis, said first diameter terminating at said inner surface, said shoulder starts at said inner surface and extends outwardly therefrom toward said outer surface a finite distance, and said shoulder extends around essentially the entire inner periphery of said inner surface of said tubular member.

* * * * *